US005316529A

United States Patent [19]

Wang

[11] Patent Number: 5,316,529

[45] Date of Patent: May 31, 1994

[54] EXERCISE MECHANISM

[76] Inventor: Leoa Wang, 58, Ma Yuan West St., Taichung, Taiwan

[21] Appl. No.: 24,746

[22] Filed: Mar. 2, 1993

[51] Int. Cl.[5] ..... A63B 22/04

[52] U.S. Cl. ..... 482/53

[58] Field of Search ..... 482/51, 52, 53, 66, 482/79, 80

[56] References Cited

U.S. PATENT DOCUMENTS 4,838,543 6/1989 Armstrong et al. ..... 482/53

5,183,448 2/1993 Wang ..... 482/52

*Primary Examiner*—Stephen R. Crow

[57] ABSTRACT

An exercise mechanism includes a pair of foot pedals pivotally coupled to a base, a post extended upward from the base, a pair of brackets fixed to the post, and a support secured to the brackets, the support is inclined relative to the post for supporting the upper portion of the users. Two or four wheels are attached to the base such that the base can be easily moved.

2 Claims, 11 Drawing Sheets

EXERCISE MECHANISM

BACKGROUND OF THE INVENTION (a) Field of the Invention

The present invention relates to an exercise mechanism, and more particularly to an exercise mechanism with which the users may feel more comfortable.

(b) Description of the Prior Art

A typical exercise mechanism is shown in FIGS. 1 and 2 and includes a pair of foot pedals 11 pivotally coupled to the base 12 and a handle 10 disposed above the base 12. However, in such an exercise mechanism, the location of the handle 10 is very low such that the upper part of the users can not be supported by the handle. In addition, the base 12 can not be moved easily.

The present invention has arisen to mitigate and/or obviate the afore-described disadvantages of the conventional exercise mechanisms.

SUMMARY OF THE INVENTION

The primary objective of the present invention is to provide an exercise mechanism in which the upper part of the users can be rested on the handle.

The other objective of the present invention is to provide an exercise mechanism which can be easily moved.

In accordance with one aspect of the present invention, there is provided an exercise mechanism comprising a base, a pair of foot pedals pivotally coupled to the base, a post extended upward from the base, a pair of brackets fixed to the post, and a support member secured to the brackets, the support member being disposed with a slope relative to the post for supporting an upper portion of a user.

The base includes a pair of extensions extended laterally outward therefrom and each having a free end portion, a sleeve rotatably engaged on each of the extensions, a barrel rotatably engaged on each of the extensions, and a wheel coupled to each of the barrels such that the base is easily movable, the foot pedals are fixed to the sleeves respectively.

Further objectives and advantages of the present invention will become apparent from a careful reading of the detailed description provided hereinbelow, with appropriate reference to the accompanying drawings.

DETAILED DESCRIPTION OF THE INVENTION

Figure 1:
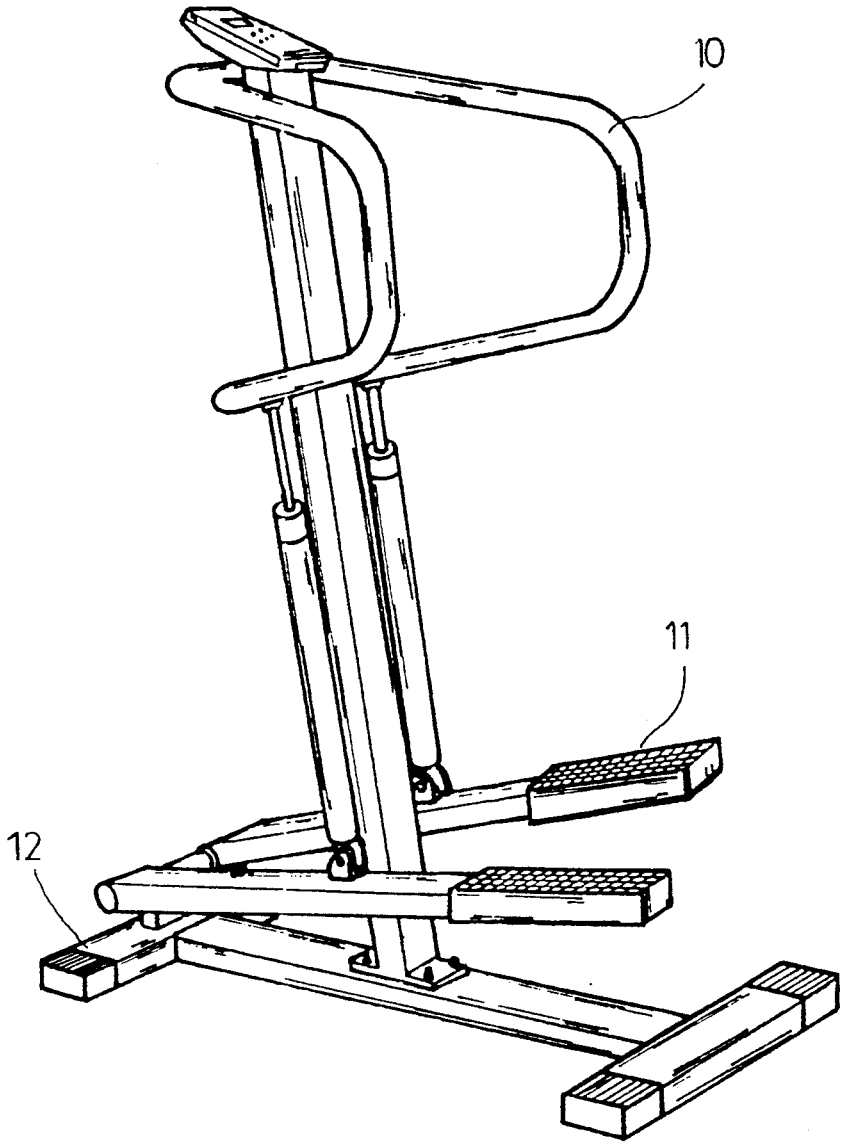
Fig.1 (PRIOR ART)
FIG. 1 is a perspective view of a typical exercise mechanism.
Figure 2:
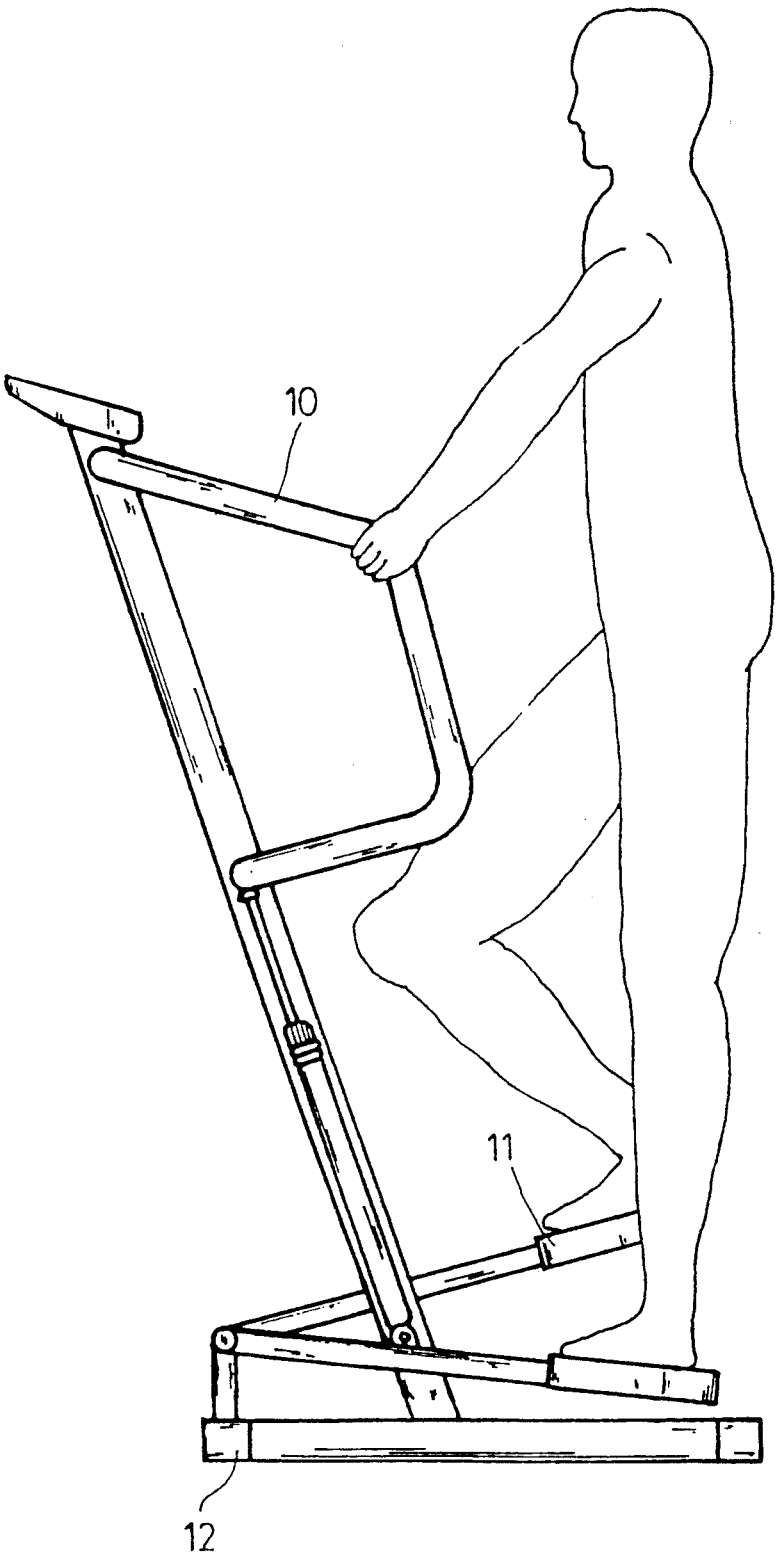
Fig.2 (PRIOR ART)
FIG. 2 is a plane view of the typical exercise mechanism.

Referring to the drawings and initially to FIGS. 3 to 7, an exercise mechanism in accordance with the present invention comprises generally a base 50 including a post 31 extended upward therefrom, a handle 20 disposed on top of the post 31, and a pair of foot pedals 33 pivotally coupled to the base 50.

Figure 5:
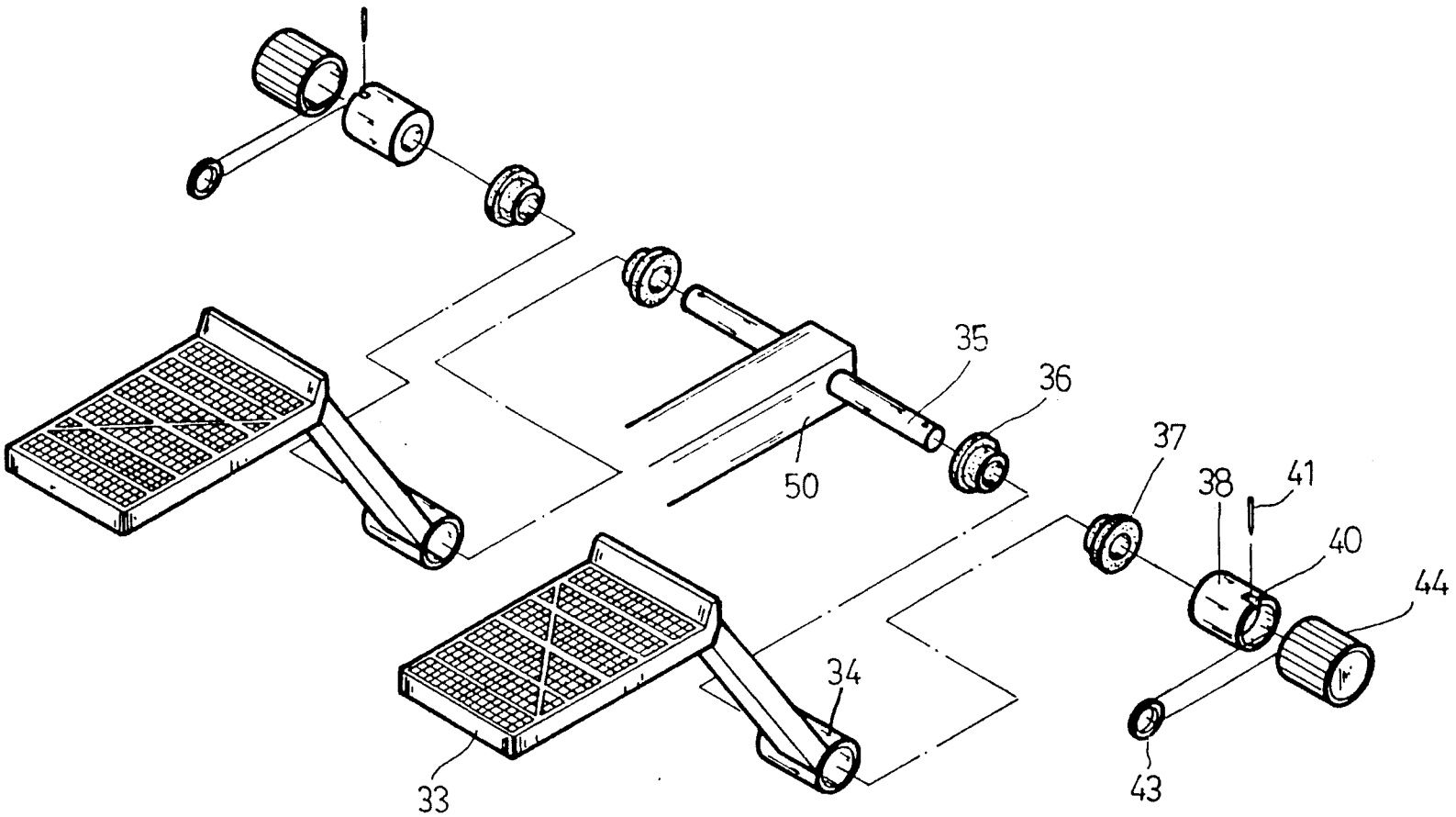
FIG. 5 is a partial exploded illustrating the base portion of the exercise mechanism.
Figure 6:
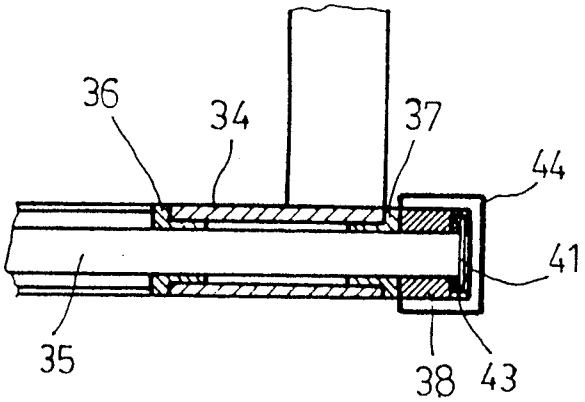
FIG. 6 is a partial cross sectional view of the base.

As shown in FIGS. 5 and 6, the base 50 includes a pair of extensions 35 extended laterally outward therefrom, a sleeve 34 rotatably engaged on each of the extensions 35 by a pair of packings 36, 37, a barrel 38 rotatably engaged on each of the extensions 35 and located on the outer portion of the extensions 35 and including a pair of notches 40 formed therein, a pin 41 extended through the notches 40 of each of the barrels 38 and extended through the respective extensions 35 in order to retain the sleeves 34 and the barrels 38 in place such that the sleeves 34 and the barrels 38 will not be disengaged from the extensions 35. As shown in FIG. 6, it is to be noted that a washer 43 is engaged between the pin 41 and the barrel 38 and the pin 41 is not engaged with the barrel 38 such that the barrels 38 are rotatably supported on the extensions 35. A foot pedal 33 is fixed to each of the sleeves 34, and a wheel 44 is fixed on each of the barrels 38 such that the base 50 can be easily moved by the wheels 44. It is preferable that four wheels 44 are provided in the base 50.

Figure 3:
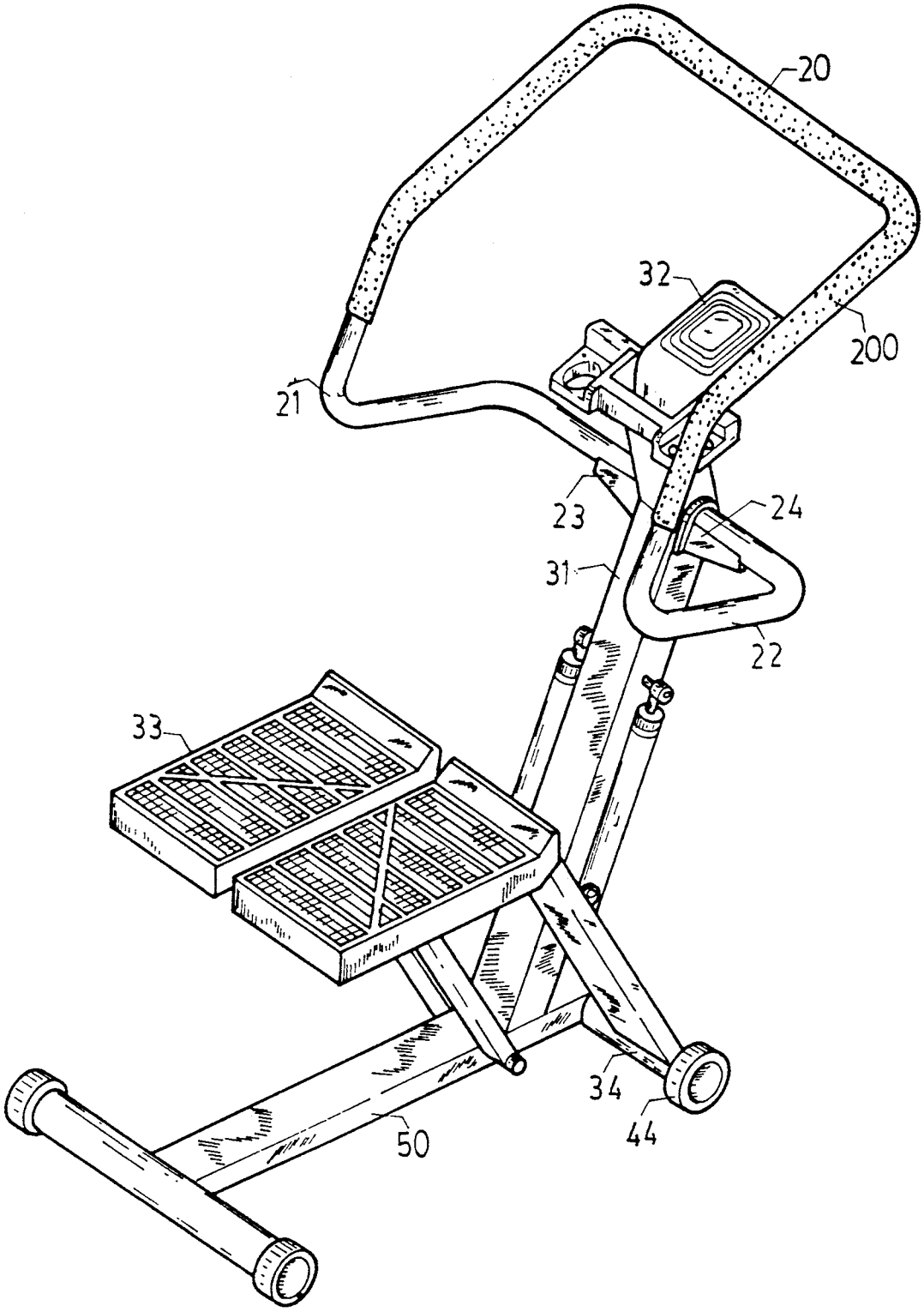
FIG. 3 is a perspective view of the exercise mechanism in accordance with the present invention.
Figure 4:
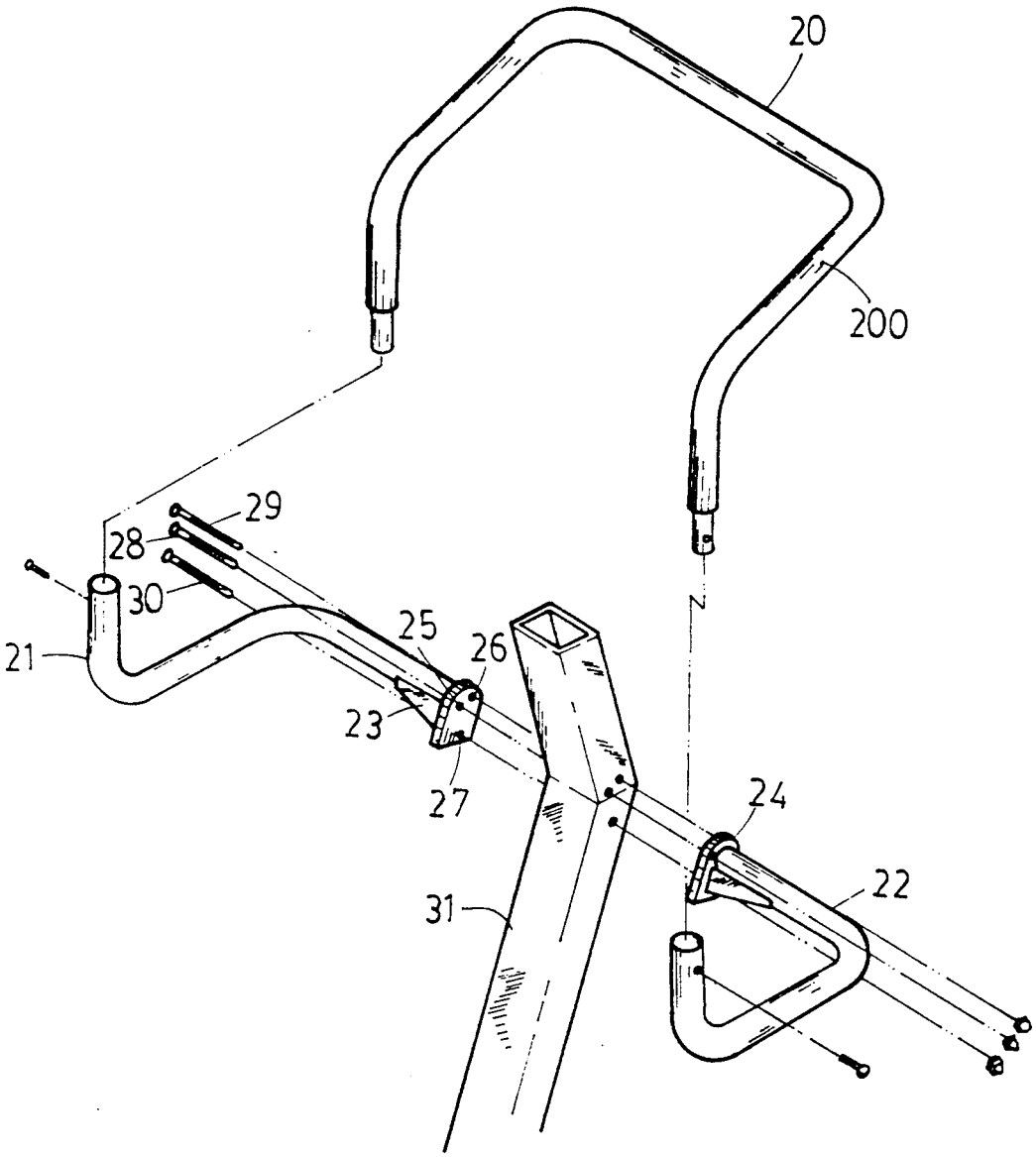
FIG. 4 is a partial exploded view illustrating the handle portion.

As shown in FIGS. 3 and 4, the handle 20 includes a pair of brackets 21, 22 each including a block 23, 24 fixed thereon, each of the blocks 23, 24 includes three screw holes 25, 26, 27 for engagement with screws 28, 29, 30 respectively such that the blocks 23, 24 can be fixed to the post 31. The handle 20 further includes a U-shaped support member 200 fixed to the brackets 21, 22 and disposed above the brackets 21, 22. It is preferable that a meter or a displayer is disposed on top of the post 31.

Figure 7:
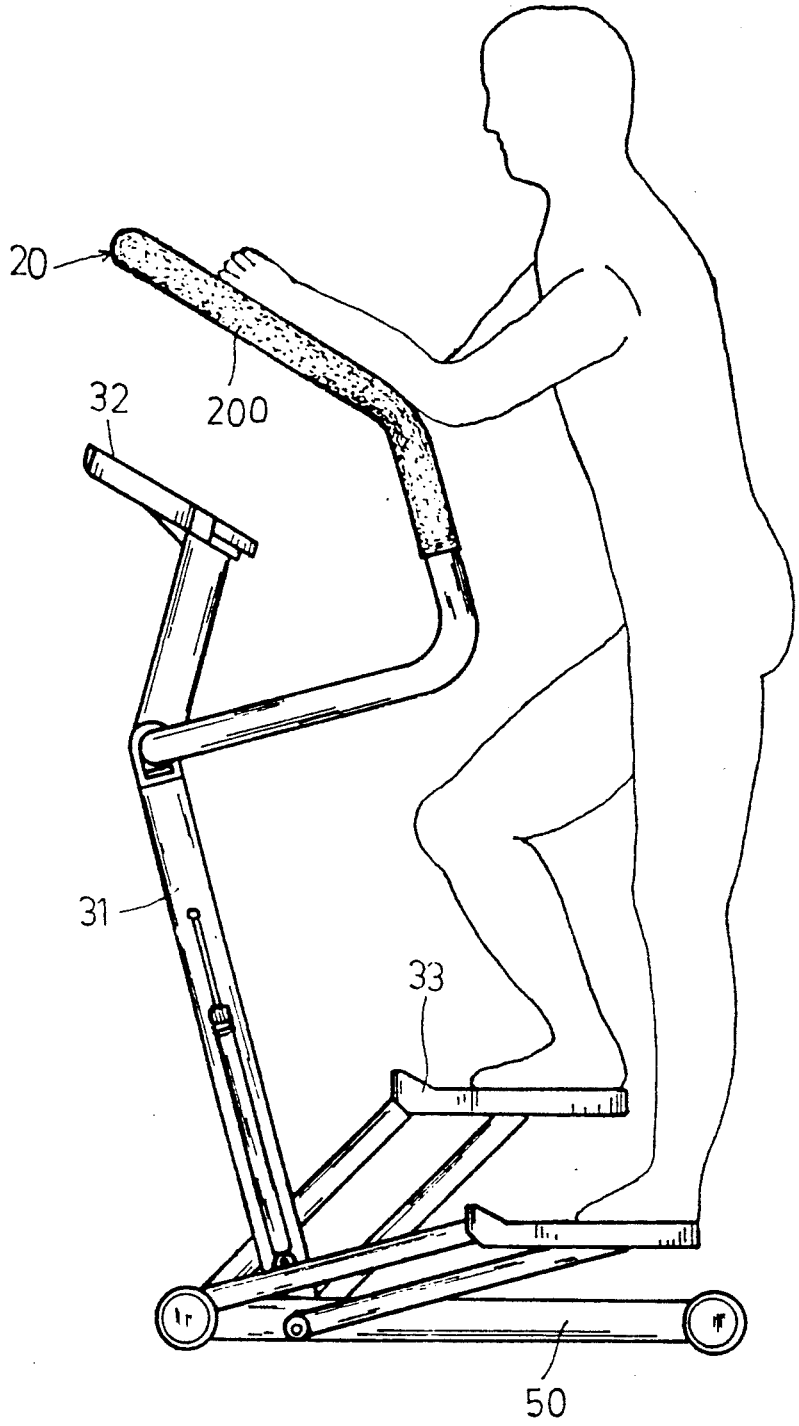
FIG. 7 is a plane view of the exercise mechanism.

In operation, as best shown in FIG. 7, the support member 200 of the handle 20 is arranged with a slope relative to the post 31 and arranged such that the arms of the users may be rested thereon, and such that the upper part of the users can be rested on the support member 200 of the handle 20.

Figure 8:
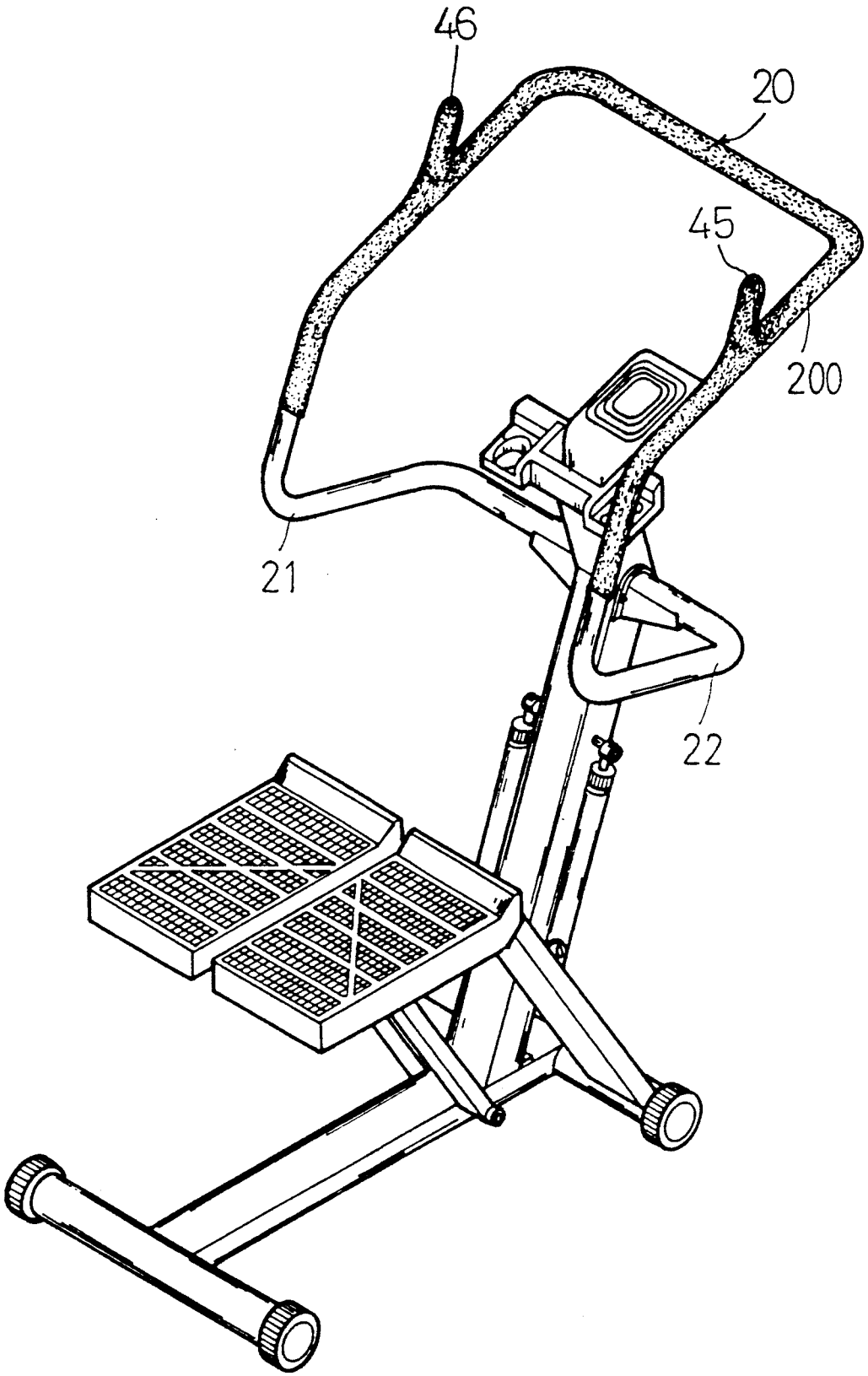
FIG. 8 is a perspective view illustrating another type of the exercise mechanism.
Figure 9:
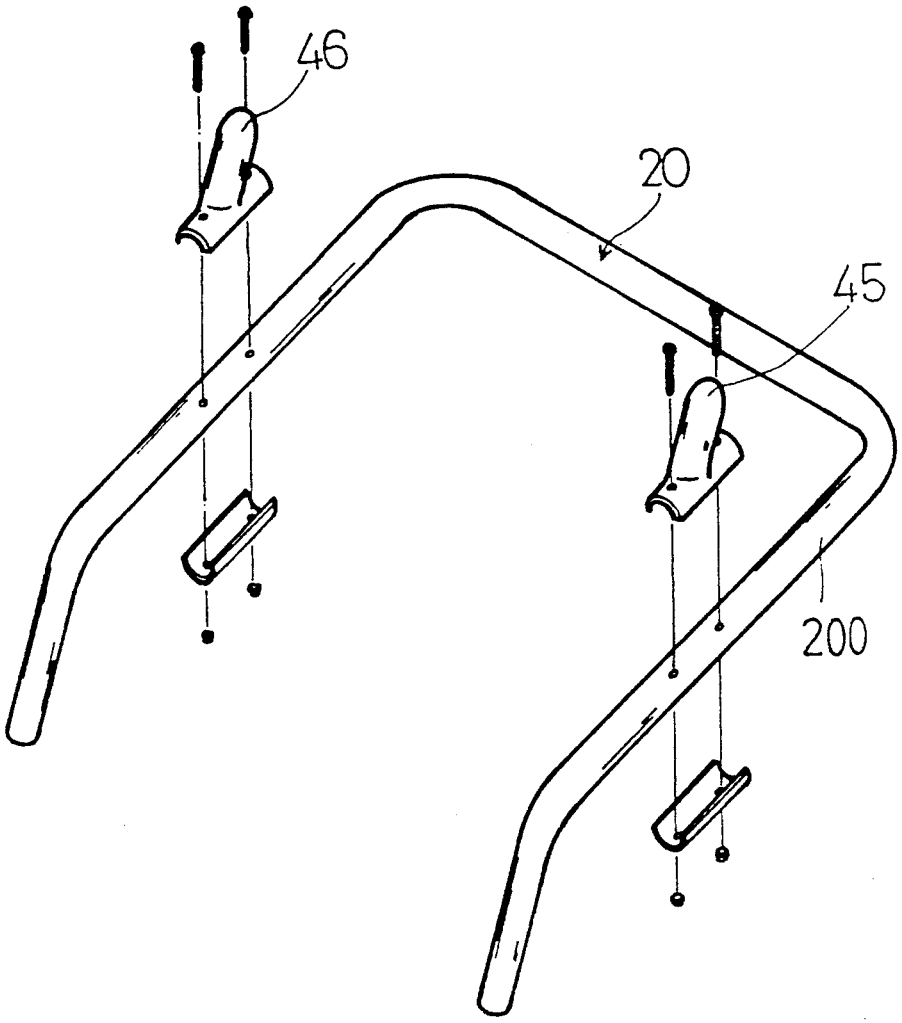
FIG. 9 is a partial exploded view of the handle portion of the exercise mechanism as shown in FIG. 8.

As shown in FIGS. 8 and 9, the support member 200 may further includes a pair of hand grips 45, 46 fixed thereon, the users may grip the hand grips 45, 46 during exercising movements.

Figure 10:
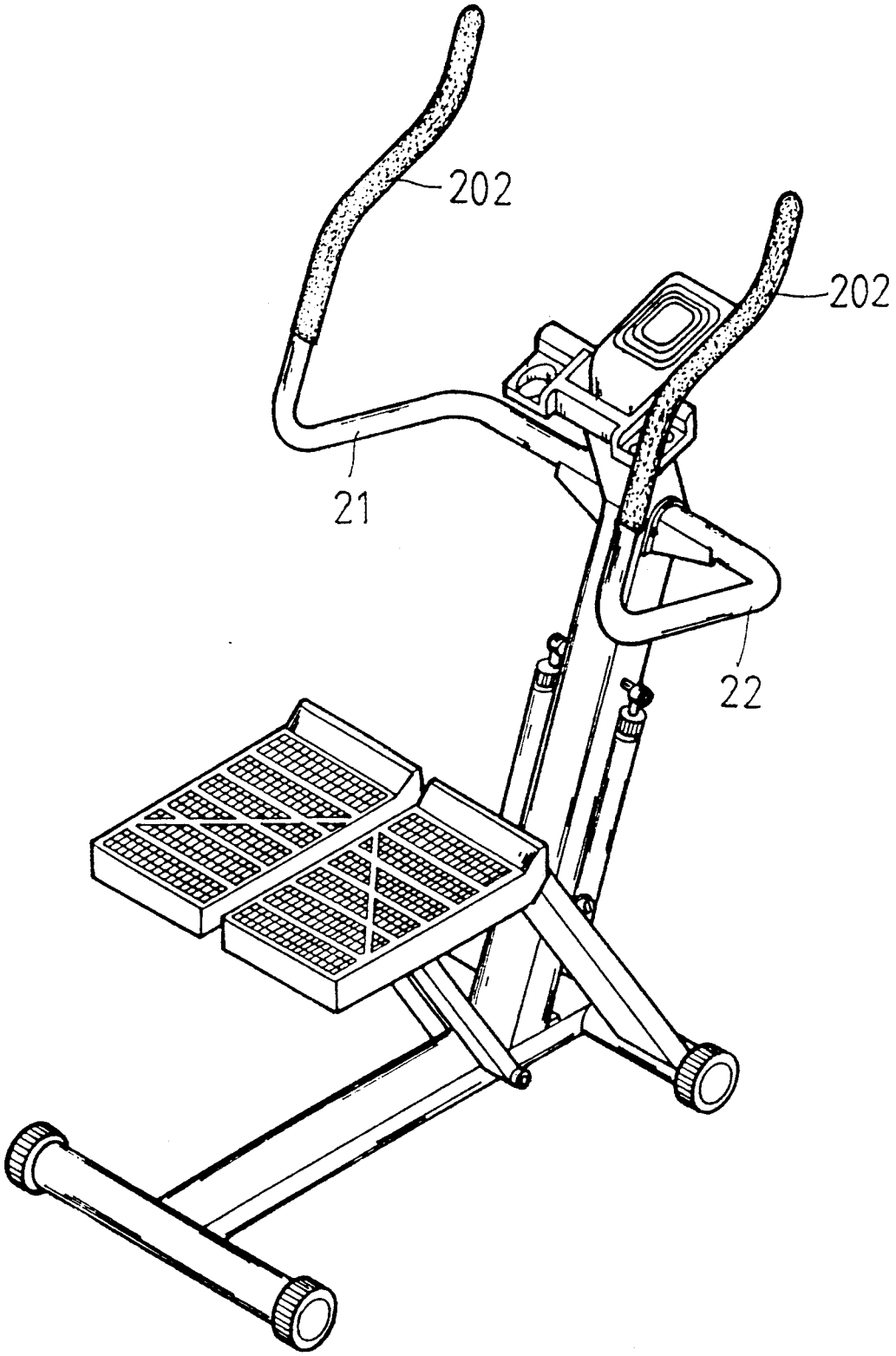
FIG. 10 is a perspective view showing another type of handle portion.
Figure 11:
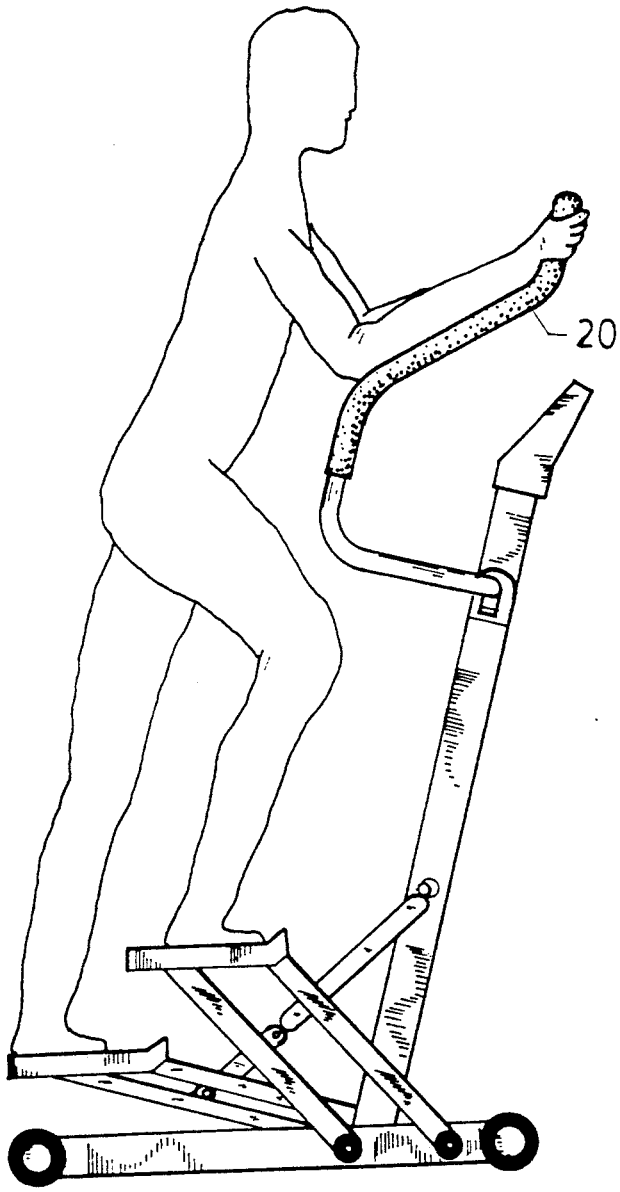
FIG. 11 is a plane view of the exercise mechanism as shown in FIG. 10.

As shown in FIGS. 10 and 11, the handle portion may include a support member 202 fixed to each of the brackets 21, 22.

Accordingly, the exercise mechanism in accordance with the present invention includes a support member with which the upper part of the users may be rested thereon, in addition, the exercise mechanism can be easily moved.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A stair step simulator type exercise mechanism comprising a base including a pair of extensions extended laterally outward therefrom and each having a free end portion, a sleeve rotatably engaged on each of said extensions, a barrel rotatably engaged on each of said extensions, and a wheel coupled to each of said barrels such that said base is easily movable relative to the stationary support surface, said foot pedals being fixed to said sleeves respectively such that said foot pedals are pivotally coupled to said base, a post extended upward from said base, a pair of brackets fixed to said post, and a support member secured to said brackets, said support member being disposed with a slope relative to said post for supporting an upper portion of a user.

2. An exercise mechanism according to claim 1, wherein each of said barrels includes a pair of notches oppositely formed therein, a pin extended through said notches of each of said barrels and engaged in the respective extension so as to retain said sleeves and said barrels in place.

* * * * *